US007654852B2

(12) United States Patent
Droesbeke et al.

(10) Patent No.: US 7,654,852 B2
(45) Date of Patent: Feb. 2, 2010

(54) CONNECTOR AND CONNECTOR ASSEMBLING SYSTEM

(75) Inventors: Gert Droesbeke, Geel (BE); Peter Poorter, Wijk en Aalburg (NL)

(73) Assignee: FCI, Versailles (FR)

( * ) Notice: Subject to any disclaimer, the term of this patent is extended or adjusted under 35 U.S.C. 154(b) by 30 days.

(21) Appl. No.: 11/630,288

(22) PCT Filed: Jun. 20, 2005

(86) PCT No.: PCT/EP2005/006580

§ 371 (c)(1),
(2), (4) Date: Jan. 14, 2008

(87) PCT Pub. No.: WO2006/002785

PCT Pub. Date: Jan. 12, 2006

(65) Prior Publication Data

US 2008/0254669 A1 Oct. 16, 2008

(30) Foreign Application Priority Data

Jun. 25, 2004 (NL) ..... 1026503

(51) Int. Cl.
*H01R 13/627* (2006.01)

(52) U.S. Cl. ..... 439/358

(58) Field of Classification Search ..... 439/350, 439/358, 357, 372, 353
See application file for complete search history.

(56) References Cited

U.S. PATENT DOCUMENTS

| | | | | |
|---|---|---|---|---|
| 4,130,327 | A | 12/1978 | Spaulding | 339/17 CF |
| 5,104,329 | A * | 4/1992 | Brown et al. | 439/108 |
| 6,250,942 | B1 | 6/2001 | Lemke et al. | 439/352 |
| 6,312,277 | B1 | 11/2001 | Holub | 439/352 |
| 6,585,536 | B1 * | 7/2003 | Wu | 439/358 |
| 2004/0121642 | A1 | 6/2004 | Jones et al. | 439/350 |

FOREIGN PATENT DOCUMENTS

| | | |
|---|---|---|
| DE | 87 14 071 | 12/1987 |
| WO | WO 97/47058 | 12/1997 |

* cited by examiner

*Primary Examiner*—Phuong K Dinh
(74) *Attorney, Agent, or Firm*—Harrington & Smith, PC

(57) ABSTRACT

A connector is described, the connector including a housing with a bottom wall and two upstanding opposite side walls determining a receiving space for receiving an insertion side of a second connector. The housing is provided with a flexible latch for locking the second connector in the receiving space of the housing. The latch is mounted in the bottom wall of the housing.

18 Claims, 5 Drawing Sheets

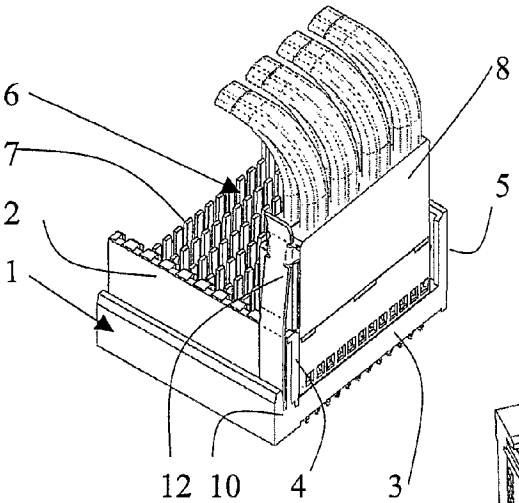
Fig. 1A
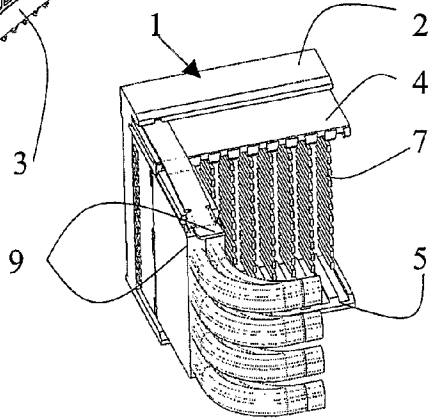
Fig. 1B
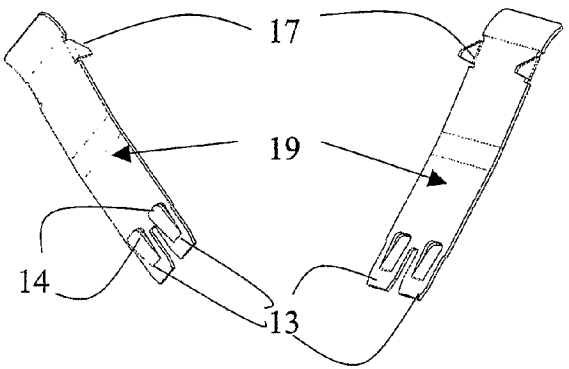
Fig. 4A
Fig. 4B
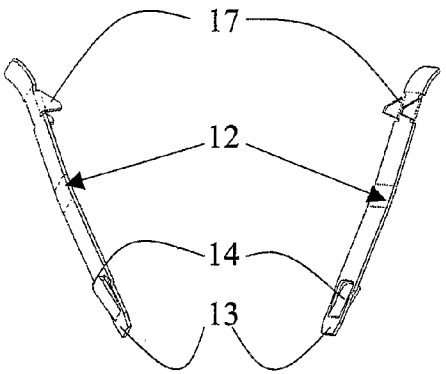
Fig. 3A
Fig. 3B
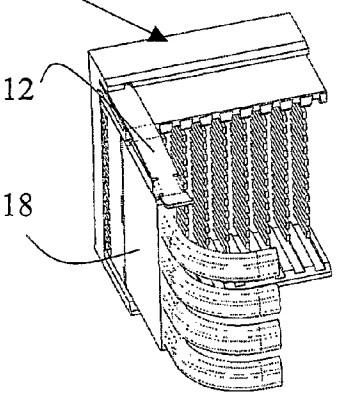
Fig. 2

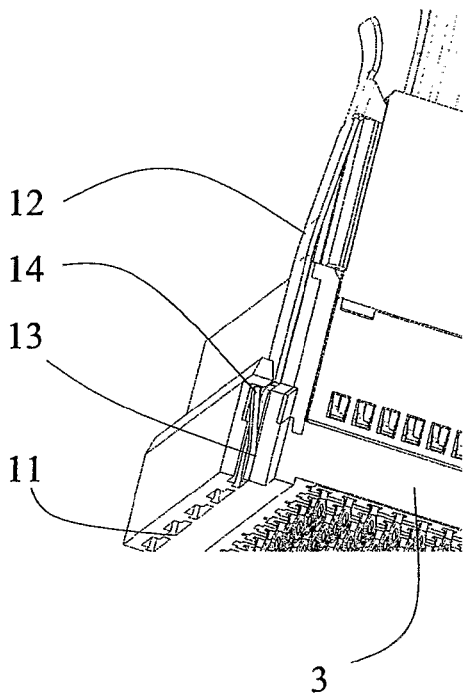
A
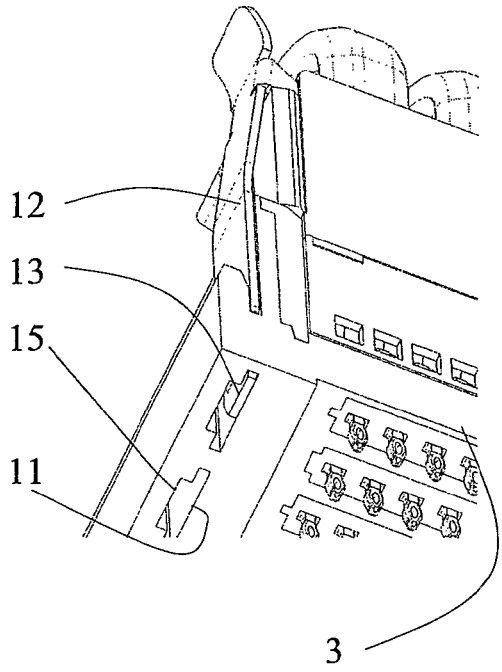
B
Fig.6
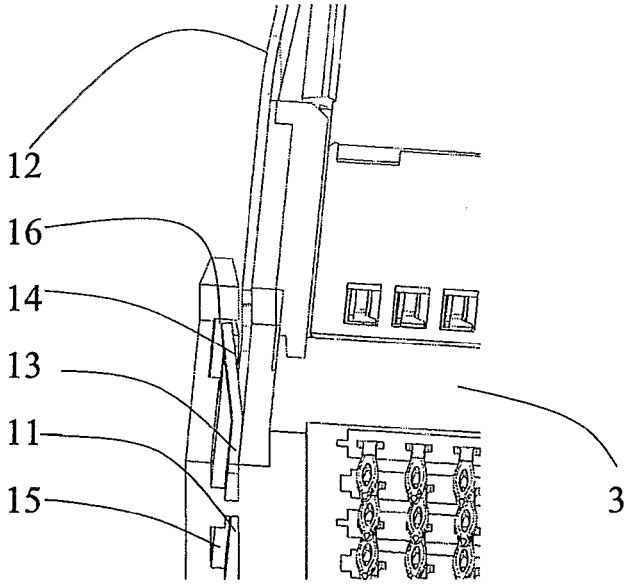
C

CONNECTOR AND CONNECTOR ASSEMBLING SYSTEM

The invention relates to a connector, comprising a connector having a housing with a bottom wall and two upstanding opposite side walls determining a receiving space for receiving an insertion side of a second connector, wherein said housing is provided with a flexible latch for locking the second connector in the receiving space of the housing, and to a connector assembling system for assembling such a connector.

WO 97/47058 discloses a connector of this type, wherein the latch is mounted on the upperside of one of the sidewalls of the second housing. Thereby, the overall height of the connector is relatively great.

The object of the invention is to provide a connector of the above-mentioned type, wherein the height of the connector can be reduced.

To this end the connector of the invention is characterized in that said latch is mounted in the bottom wall of the housing.

In this manner a connector is obtained, wherein the height of the connector can be reduced so that a connector is obtained with a low profile.

In a preferred embodiment the bottom wall of the housing is provided with a row of mounting slots and said latch is provided with at least one mounting tongue which is inserted into a mounting slot of the bottom wall. In this manner the latch can be mounted in the second housing at any desired location depending on the size of the first connector and location where the second connector is to be inserted into the receiving space.

In an advanteagous embodiment said latch is provided with two mounting tongues received in mounting slots of the bottom wall of the housing. Providing a second type of latch results in an increased flexibility in use of the connector according to the invention, wherein depending on the size of the first connector a latch with one or two mounting tongues and corresponding width can be used.

In another aspect of the invention at least one side wall of the housing is provided with a row of mounting slots and said latch is provided with at least one mounting tongue which is inserted into a mounting slot of the side wall.

The invention further provides a connector assembling system, comprising a connector having a housing with a bottom wall and two upstanding opposite side walls determining a receiving space, and a latch to be mounted in the connector housing, wherein according to the invention this system is characterized in that the bottom and/or at least one side wall of the connector housing is provided with a row of mounting slots and said latch is provided with at least one mounting tongue which can be inserted into any mounting slot of the row of mounting slots.

The invention will be further explained by reference to the drawings showing some embodiments of the connector according to the invention.

FIGS. 1A and 1B show a first embodiment of the connector according to the invention, wherein a second connector is inserted into the receiving space.

FIG. 2 shows the connector of FIG. 1, wherein a different second connector is inserted into the receiving space.

FIGS. 3 and 4 show different examples of a latch to be used in the connector of the invention.

FIGS. 6A-6C are different views of a part of the connector of FIG. 1 at a larger scale to show the mounting of the latch in the bottom wall of the connector housing.

Figure 5:
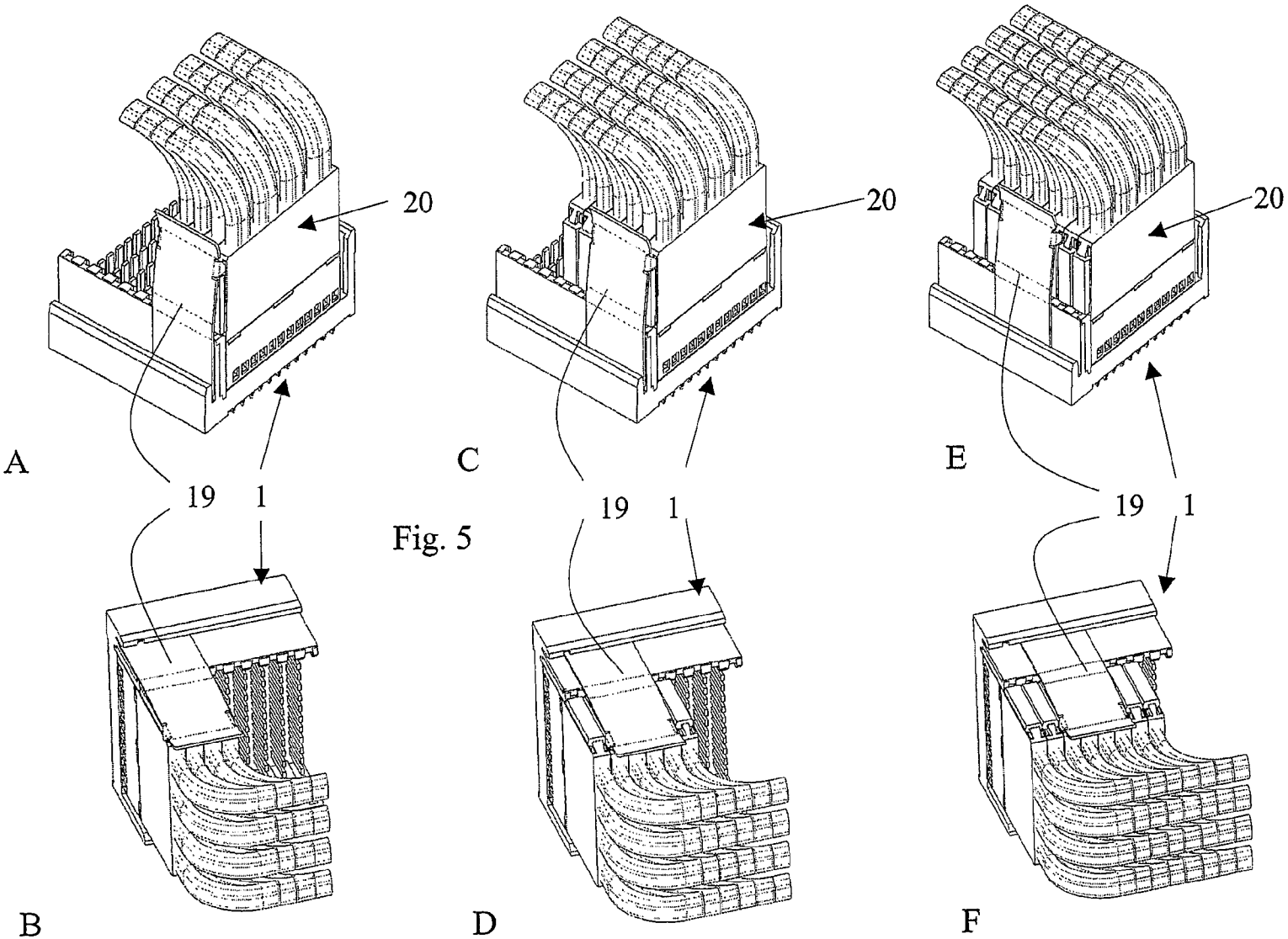
FIGS. 5A-5F show different embodiments of the connector of the invention, wherein second connectors of various sizes are inserted into the receiving space.

FIGS. 1A and 1B show different perspective views of a connector 1 having a header or housing 2 with a bottom wall 3 and two upstanding sidewalls 4 and 5. The bottom wall 3 and sidewalls 4, 5 determine a receiving space 6 accommodating a number of contact elements 7 and adapted to receive a second connector 8, which in the embodiment of FIG. 1 is made as a cable connector comprising two coupled connector wafers 9. Such a cable connector assembled of coupled connector wafers is described in more detail in a co-pending patent application of the same filing date of the same applicant. For a detailed description reference is made to this co-pending patent application.

Figure 7:
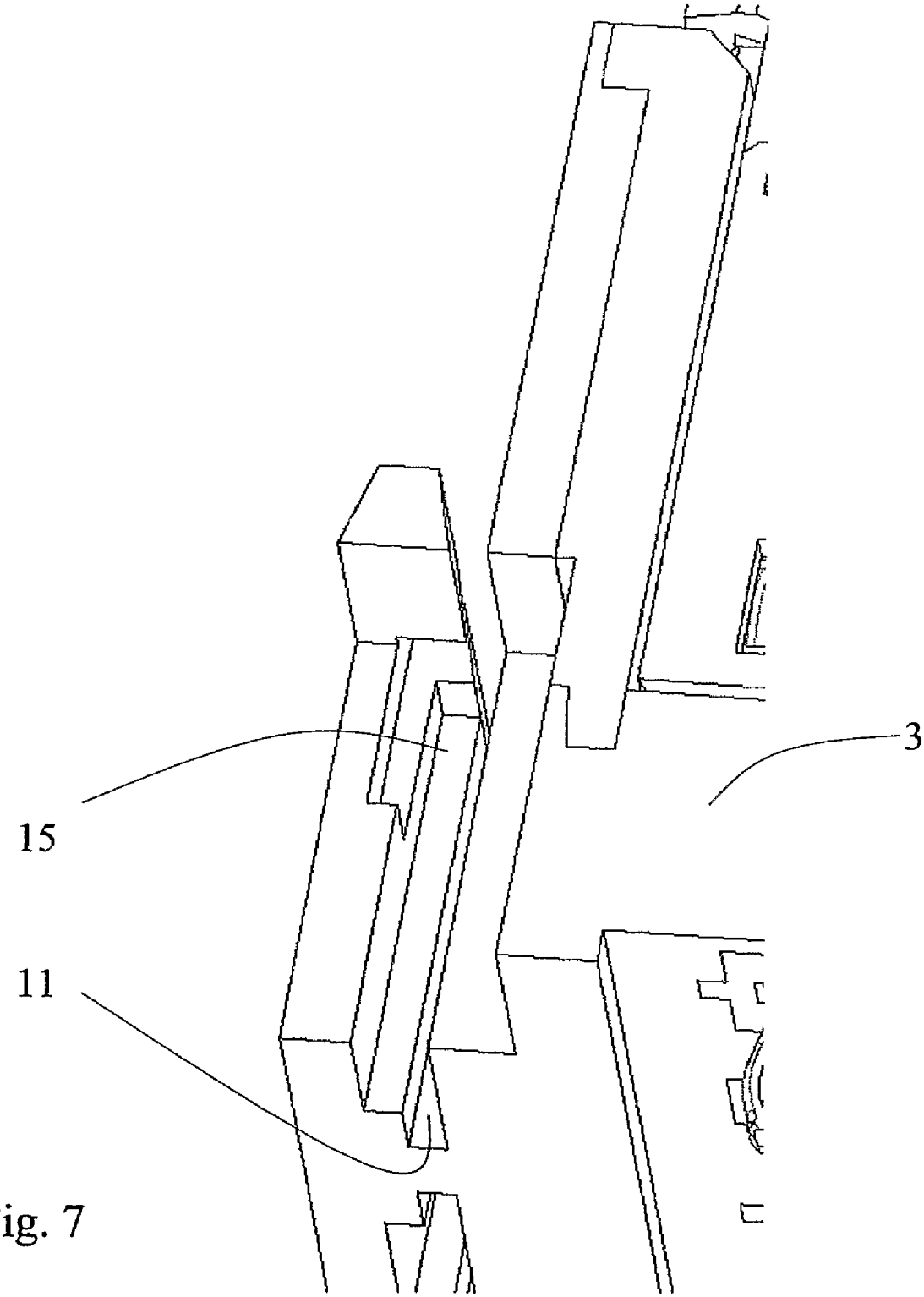
FIG. 7 shows a part of the housing of the connector of FIG. 1 at a larger scale.

As can be seen in FIG. 1, the bottom wall has an extension 10 outside the receiving space 6 adjacent to the sidewall 4. In this extension part 10 of the bottom wall 3 a row of mounting slots 11 is provided as can be seen in FIGS. 6 and 7 showing a part of the connector 1 in more detail at a larger scale. These mounting slots 11 are provided for mounting a flexible latch 12 which in the embodiment shown is made of metal sheet. The latch 12 is shown in more detail in FIGS. 3A and 3B. The latch 12 is provided with a mounting tongue 13 and as can be seen in FIG. 6, this mounting tongue 13 is inserted into a mounting slot 11 of the bottom wall 3. The mounting tongue 13 is provided with a locking lip 14 and each mounting slot 11 is provided with a locking slot 15 determining a stop 16. When the connector 1 is assembled with a latch 12, the mounting tongue 13 is inserted into one of the mounting slots 11, wherein the locking lip 14 is forced inwardly. When the fully inserted position is reached, the locking lip 14 springs back into the locking slot 14 and engages the stop 16 thereby fixing the latch 12 in the mounting slot 11.

At its end opposite of the mounting tongue 13, the latch 12 comprises two protrusions 17 engaging the second connector 8 when the second connector 8 is fully inserted into the receiving space 6. The latch 12 can be disengaged from the second connector 8 if the second connector has to be disconnected from the connector 1.

As can be seen in FIG. 2, the latch 12 is adapted to engage a different size connector 18 which comprises only one connector wafer 9.

FIGS. 4A and 4B show a latch 19 which is used in the embodiment of the connector 1 shown in FIGS. 5A-5F. The latch 19 is made in the same manner as the latch 12 of FIG. 3, wherein the width of the latch 19 is substantially twice the width of the latch 12. The latch 19 is provided with two mounting tongues 13, each mounting tongue 13 having a locking lip 14. The pitch of the mounting tongues 13 corresponds with the pitch of the mounting slots 11, so that the mounting tongues 13 can be inserted into any two adjacent mounting slots 11. In this manner the latch 19 can be mounted in any desired position with respect to the housing 2 of the connector 1 depending on the type of connector 20 to be inserted into the receiving space 6 of the connector 1. As an alternative the latch 19 can have such dimensions and pitch of the mounting tongues 13 that one or more mounting slots 11 are skipped. It is also possible to provide a latch with three or more mounting tongues.

Different sizes of a connector 20 comprising four, six or eight connector wafers 9, are shown in FIG. 5 with corresponding possible positions of the latch 19 to provide a secure locking of the connector 20 to the connector 1. In the same manner the latch 12 can be mounted in any desired position with respect to the connector 1. Further it is possible to provide the connector 1 with a combination of a latch 12 and a latch 19 or combinations of two or more latches 12 and 19. Moreover, in cases where two connector 1 are mounted adjacent to one another, the distance between two adjacent mounting slots 1 corresponds with the pitch of the mounting slots 1 so that the latch 19 can also be mounted with its two mounting tongues in mounting slots 11 of the adjacent connectors 1.

It will be clear that with the connector housing 2 and latches 12 and 19 it is possible to assemble a connector 1 with one or more latches 12, 19 at any desired position with respect to the connector housing 2. As the locking slots 15 are accessible from the side of the bottom wall 3 opposite of the receiving space 6, a latch 12 or 19 can be easily removed from the connector housing 2 by inserting a suitable tool into the locking slot(s) 15. In this manner an assembled connector 1 can easily be adapted to its intended use.

As the latch 12, 19 is mounted in the bottom wall 3 of the connector 1, the overall height of the connector 1 with connector 8 or 20 inserted into the receiving space 6 can be low thereby providing a low profile connector system.

Figure 8B:
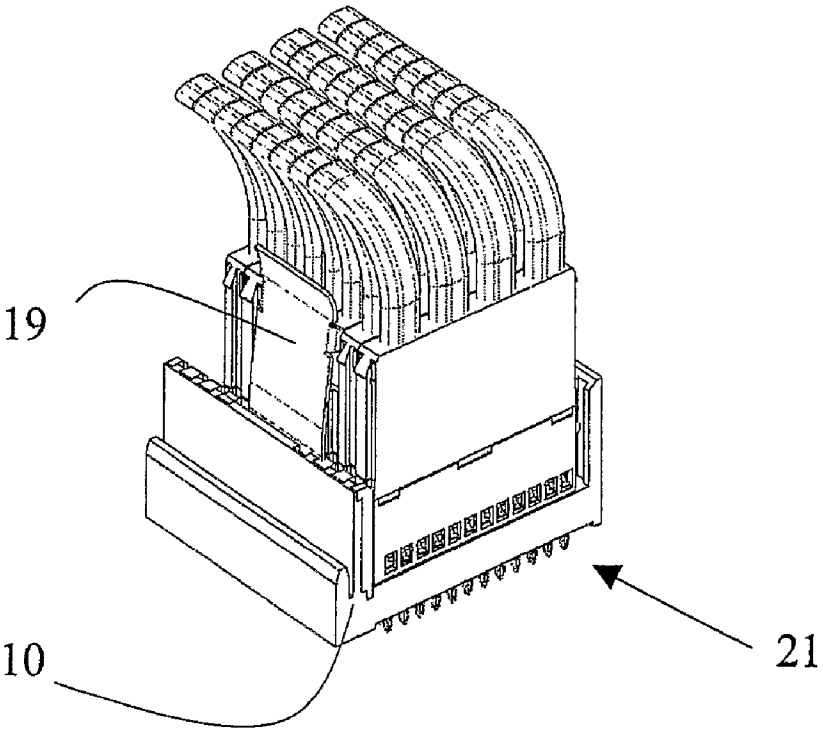
FIGS. 8A and 8B show a further embodiment of the connector of the invention.
Figure 8A:
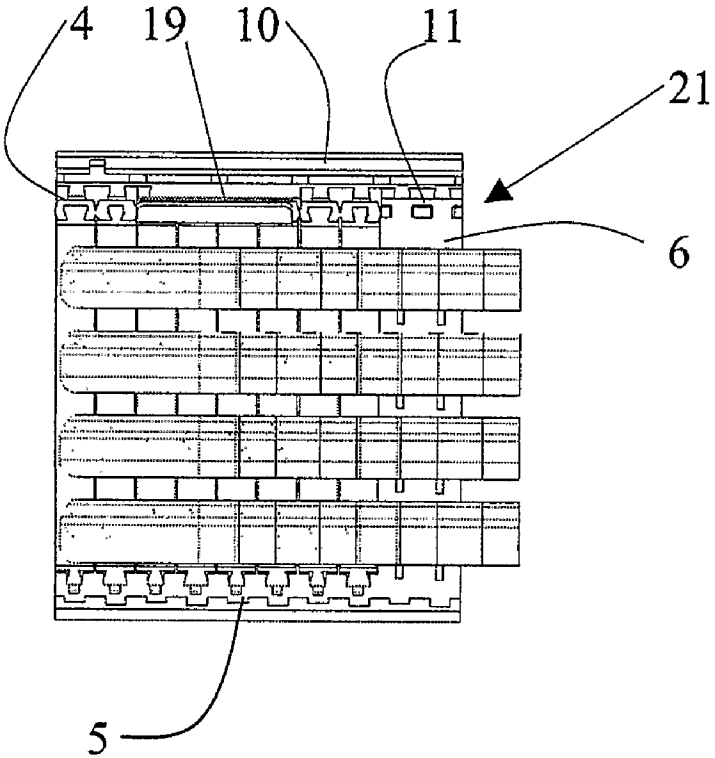

FIG. 8A and 8B show a top view and perspective view, respectively of a second embodiment of the connector of the invention indicated by reference numeral 21. In this case the row mounting slots 11 is provided at the inner side of the sidewall 4 within the receiving space 6. In this manner the width of the connector housing 2 can be reduced by deleting the extension part 10. In the embodiment of FIG. 8, a latch 19 is used. However it is of course also possible to use a latch 12 and any combination of latches 12 and 19.

In an alternative embodiment the row of mounting slots can be provided in the upper end of a side wall. Although this will result in an increase of the connector height, it is still possible to maintain all further features of the described connector and connector assembling system. In particular such an embodiment provides the flexibility to assemble a desired connector with one or more latches at any desired position on the connector housing.

The invention is not restricted to the above-described embodiments which can be varied in a number of ways within the scope of the following claims.

The invention claimed is:

1. Board connector, comprising a header housing with a bottom wall and two upstanding opposite side walls determining a receiving space adapted to receive a second connector, wherein said housing is provided with a flexible latch adapted to lock the second connector in the receiving space of the housing, characterized in that the bottom wall of the housing is provided with a row of mounting slots formed adjacent to at least one of the side walls and extending along a majority of a length of at least one of the side walls, wherein the mounting slots are adapted to receive the latch.

2. Board connector according to claim 1, wherein said latch is provided with at least one mounting tongue which is inserted into the mounting slot of the bottom wall.

3. Board connector according to claim 2, wherein said latch is provided with two mounting tongues received in the mounting slots of the bottom wall of the housing.

4. Board connector according to claim 1, wherein a mounting tongue of the latch is provided with a locking lip and each mounting slot is provided with a locking slot, wherein the locking lip is received in one of the locking slots to lock the latch in the bottom wall.

5. Board connector according to claim 1, wherein said row of mounting slots is provided within the receiving space.

6. Board connector according to claim 1, wherein said row of mounting slots is provided in an extension part of the bottom wall outside the receiving space.

7. Board connector according to claim 1, wherein the latch is a one-piece sheet metal member.

8. Board connector according to claim 7, wherein the latch comprises a mounting tongue which is inserted into one of the mounting slots, and wherein the mounting tounge comprises a resiliently deflectable locking lip extending from the mounting tongue.

9. Board connector according to claim 8, wherein the locking lip is a stamped cantilvered tab extending from the mounting tongue.

10. Board connector, comprising a header housing with a bottom wall and two upstanding opposite side walls determining a receiving space configured to receive a second connector, wherein said housing is provided with a flexible latch configured to lock the second connector in the receiving space of the housing, characterized in that the bottom wall and at least one of the side walls of the housing is provided with a row of mounting slots extending along a majority of a length of the bottom wall and the at least one side wall, and said latch is provided with at least one mounting tongue which is inserted into a first one of the mounting slots of the side wall, wherein the mounting tongue comprises a resiliently deflectable locking lip extending from a rest of the mounting tongue inside the first slot.

11. Board connector according to claim 10, wherein said latch is provided with two of the mounting tongues received in the mounting slots of the bottom wall of the housing.

12. Board connector according to claim 10, wherein the latch is a one-piece sheet metal member.

13. Connector according to claim 12, wherein the locking lip is a stamped cantilvered tab.

14. Connector assembling system, comprising a connector having a housing with a bottom wall and two upstanding opposite side walls determining a receiving space, and a latch adapted to be mounted on the connector housing, characterized in that the bottom wall and/or at least one of the side walls of the connector housing is provided with a row of mounting slots to produce an operable mounting of the latch to the connector housing, and wherein said latch is provided with at least one mounting tongue which can be inserted into any one of the mounting slots of the row of mounting slots, wherein the at least one mounting tongue comprises a resiliently deflectable locking lip, wherein the latch is a one-piece sheet metal member, and wherein the locking lip is a stamped cantilvered tab.

15. Connector assembling system according to claim 14, wherein said latch is provided with two of the mounting tongues which can be inserted in two of the mounting slots of the row of slots.

16. Connector assembling system according to claim 14, wherein each mounting slot is provided with a locking slot, wherein the locking lip is adapted to be received in the locking slot to lock the latch in the connector housing.

17. Connector assembling system according to claim 16, wherein the locking slot is accessible from the side of the bottom wall opposite of the receiving space, and is shaped such that a tool can be inserted into the locking slot to disengage the locking lip to allow removing of a latch.

18. Connector assembling system comprising a connector having a housing with a bottom wall and two upstanding opposite side walls determining a receiving space, and a latch adapted to be mounted on the connector housing, characterized in that the bottom wall and/or at least one of the side walls of the connector housing is provided with a row of mounting slots, and wherein said latch is provided with at least one mounting tongue which can be inserted into any one of the mounting slots of the row of mounting slots, wherein the at least one mounting tongue comprises a resiliently deflectable locking lip, wherein the latch is a one-piece sheet metal member, and wherein the locking lip is stamped cantilvered tab, wherein a distance between mounting slots of adjacent connector housings corresponds with a pitch of the row of mounting slots such that two of the mounting tongues of a latch can be inserted into mounting slots of adjacent connector housings.

* * * * *